313-422 SR
11/13/79 XR 4,174,523

United States Patent [19]
Marlowe et al.

[11] 4,174,523
[45] Nov. 13, 1979

[54] FLAT DISPLAY DEVICE

[75] Inventors: Frank J. Marlowe, Kingston; Charles H. Anderson, Rocky Hill, both of N.J.

[73] Assignee: RCA Corporation, New York, N.Y.

[21] Appl. No.: 705,926

[22] Filed: Jul. 16, 1976

[51] Int. Cl.[2] ..... H01J 29/72; H01J 29/08; H01J 31/08

[52] U.S. Cl. ..... 358/67; 313/471; 313/422

[58] Field of Search ..... 313/422, 471, 472, 470

[56] References Cited

U.S. PATENT DOCUMENTS

| | | | |
|---|---|---|---|
| 2,727,184 | 12/1955 | Miller et al. | 313/471 X |
| 2,827,591 | 3/1958 | Bowie | 313/471 X |
| 2,892,020 | 6/1959 | Sziklai | 313/471 X |
| 2,942,145 | 6/1960 | Sleeper | 315/12 |
| 2,943,219 | 6/1960 | Bryan | 313/471 X |
| 4,028,582 | 6/1977 | Anderson et al. | 313/422 |

*Primary Examiner*—Robert Segal
*Attorney, Agent, or Firm*—Glenn H. Bruestle; Donald S. Cohen; George E. Haas

[57] ABSTRACT

An evacuated envelope has a rectangular display section and a gun section at one edge of the display section. The display section includes front and back walls which are generally rectangular, in closely spaced, parallel relation, and a plurality of spaced, parallel support walls between the front and back walls forming a plurality of parallel channels. At one side of the display section is at least one keying channel which extends parallel to the channels of the display section. The gun section extends across one end of the channels and includes therein gun structure which will direct electrons into the channels. In each of the channels is a beam guide which confines the electrons in a beam and guides the beam along the length of the channel; means for selectively deflecting the electron beam out of the guide toward the front wall at selective points along the guide so that in the display channels the beams will impinge upon a phosphor screen along the inner surface of the front wall; and a scanning deflector which deflects the path of the beam transversely across its channel as the beam passes from the guide to the front wall so that each of the beams in the display channels will scan a portion of the phosphor screen. In the keying channel is means for detecting the position of the beam as it is deflected transversely across the channel along the entire length of the deflected path of the beam.

11 Claims, 6 Drawing Figures

FLAT DISPLAY DEVICE

BACKGROUND OF THE INVENTION

The present invention relates to a guided beam type of flat display device wherein at least one and preferably each of a plurality of electron beams are scanned over a different area portion of an image screen.

One structure which has been proposed for a large area screen flat display device comprises a thin box-like envelope with one of the large sides thereof constituting a faceplace on which a phosphor screen is disposed. Within the envelope are a plurality of spaced, parallel support (against external atomospheric pressure) walls perpendicularly disposed to and between the large sides of the envelope thereby forming a plurality of parallel channels. Across one end of the channels is a gun structure which directs at least one electron beam along each of the channels. In each of the channels is a beam guide which confines the electron beam in the channels and guides the beam along the length of the channel. The beam guide also includes means for deflecting the electron beam out of the beam guide at selected points along the beam guide. The beams in all of the channels are preferably simultaneously deflected out of their beam guides toward the phosphor screen at each of the selected points.

Along the support walls at each side of each channel are deflection electrodes whereby each beam in each channel can be deflected transversely across the channel to achieve a line-by-line scanning of a portion of the phosphor screen. As the beams are deflected transversely across their respective channels, the beams are modulated to provide a desired display on the phosphor screen. A display of this type is described in the application for U.S. Letters Patent of C. H. Anderson, et al., Ser. No. 615,353 filed Sept. 22, 1975, now U.S. Pat. No. 4,028,582, issued June 7, 1977, entitled "Guided Beam Flat Display Device".

A problem in this type of display device is to be sure that each beam is in the proper position when it is modulated with the desired information. If any beam overscans its channel while it is being modulated, some of its contribution to the overall display is lost. Conversely, if a beam underscans its channel, blank spots will occur in the display. Therefore, it would be desirable to provide means for controlling the modulation of the beams with respect to the position of the beams to achieve a satisfactory display.

SUMMARY OF THE INVENTION

An electron display device includes an evacuated envelope having a substantially flat front wall and a phosphor screen along the inner surface of the front wall. In the envelope is means for generating a plurality of beams of electrons and directing the beams along paths at least portions of which extend toward the front wall so that some of the beams will impinge on the phosphor screen. Along the portions of the paths which extend toward the front wall is means for simultaneously deflecting the beams so that the beams which impinge on the phosphor screen will each scan a portion of the phosphor screen. Also in the envelope is means for substantially continuously detecting the position of at least one of the beams as the beam is deflected.

DETAILED DESCRIPTION

Figure 1:
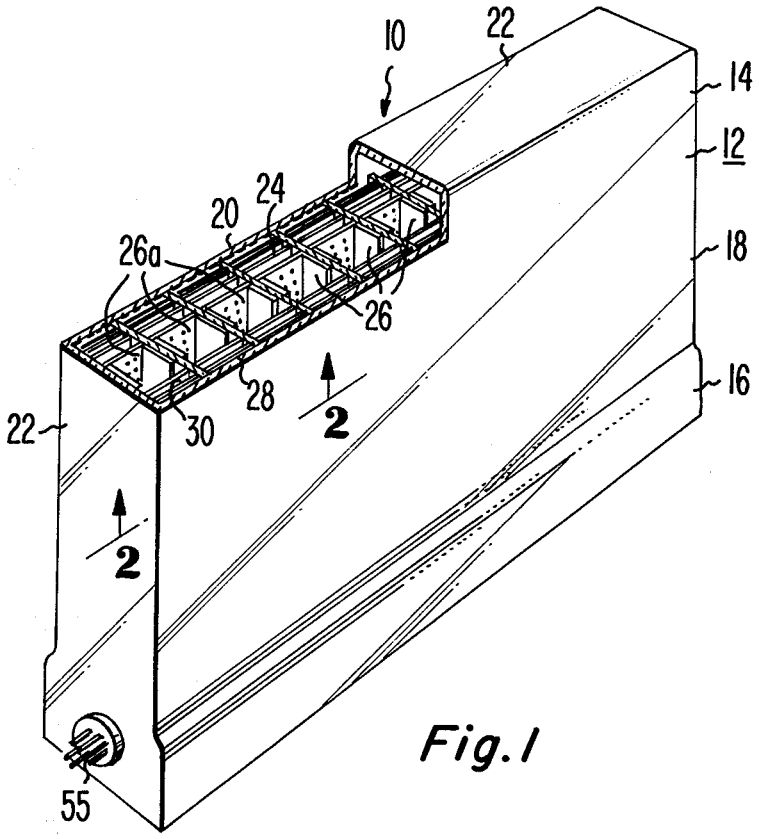
FIG. 1 is a perspective view of a guided beam flat display device of the present invention.

Referring to FIG. 1, a flat display device including the scan deflection structure of the present invention is generally designated as 10. The display device 10 comprises an evacuated envelope 12, typically of glass, having a display section 14 and an electronic gun section 16. The display section 14 includes a rectangular front wall 18 which is the viewing screen, and a rectangular back wall 20 in spaced parallel relation to the front wall 18. The front wall 18 and back wall 20 are connected by side walls 22.

Figure 2:
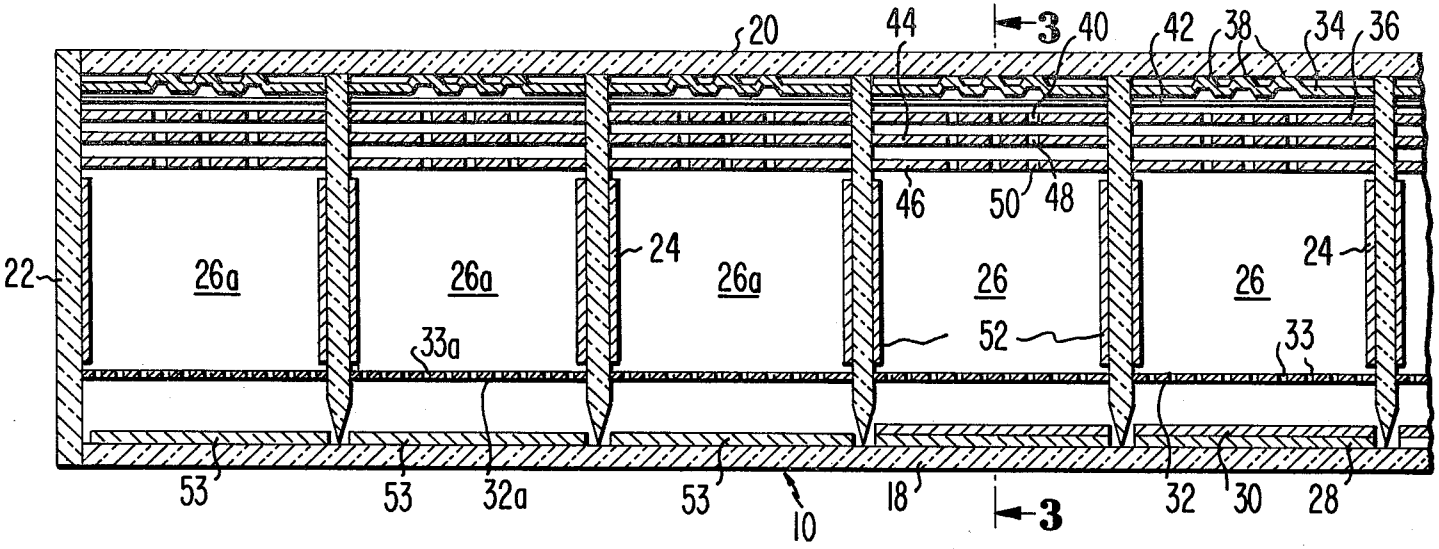
FIG. 2 is a sectional view of a portion of the display device taken along line 2—2 of FIG. 1 and showing one form of a keying channel of the present invention.

As shown in FIG. 2, a plurality of spaced, substantially parallel, support walls 24, made of an electrically insulating material, such as glass, are secured between the front wall 18 and the back wall 20 and extend from the gun section 16 to the opposite side wall of the envelope 12. The support walls 24 provide the internal support for the evacuated envelope 12 against external atmospheric pressure, and divide the display section 14 into a plurality of channels 26 and **26*a*. The edge of each of the support walls 24 which extends along the front wall 18 are tapered so as to provide a minimum area contact between the support walls 24 and the front wall 18. Three channels 26*a* are provided along one side wall 22 and serve as keying channels as will be explained, while the channels 26** are display channels.

On the inner surface of the front wall 18 in each of the display channels 26 is a phosphor screen 28. For a black and white display the phosphor screen 28 is of any well known composition used in black and white display devices. For a color display, the phosphor screen 28 is preferably made up of alternating strips of conventional phosphor compositions which emit red, green and blue when excited by electrons. On the phosphor screen 28 is a film 30 of an electrically conductive metal which is transparent to electrons, such as aluminum. A shadow mask 32 extends across each of the display channels 26 and a shadow mask **32*a* extends across each of the keying channels 26*a* adjacent to but spaced from the front wall 18. The shadow masks 32 and 32*a* are mounted on the supporting walls 24 and extends the full length of the channels 26 and 26*a*. For a phosphor screen 28 made up of alternating strips, the shadow masks 32 and 32*a* each include rows of elongated openings 33 and 33*a*** respectively, for example as described in U.S. Pat. No. 3,766,419 to R. L. Barbin, issued Oct. 16, 1973, entitled "Cathode-Ray Tube With Shadow Mask Having Random Web Distribution".

In each of the channels 26 and **26*a* adjacent the back wall 20 is an electron beam guide. The electron beam guide may be of any construction which will guide one or more electron beams along a first path extending along the length of the channel and will allow deflection of the beam at spaced points along the channel into a second path extending towards the front wall 18**. As shown, the electron beam guides may be of the type disclosed in the copending application of T. Credelle, Ser. No. 607,490, filed Aug. 25, 1975, entitled "Flat Display Tube With Beam Guide".

Each electron beam guide includes a first metal ground plane plate 34 extending along the inner surface of the back wall 20, and a second metal ground plane plate 36 spaced from and substantially parallel to the first ground plane plate 34. The first metal ground plane plate 34 has three U-shaped troughs 38 which face the second ground plane plate 36 and which extend in parallel relation along the entire length of the channel 26 and 26*a*. The first ground plane plate 34 may be made of a single sheet of a conductive metal or may be a plurality of metal strips extending in parallel relation across the channel 26 and 26*a* and are spaced longitudinally along the channel.

The second ground plane plate 36 is of a sheet of an electrically conductive metal and has three rows of spaced holes 40 therethrough with each row of the holes being over a separate one of the troughs 38 in the first ground plane 34.

A plurality of wires 42 extend transversely across the channel 26 between the first and second ground plane plates 34 and 36. The wires 42 are transverse to the longitudinal dimension of the channel and are in spaced parallel relation along the entire length of the channel 26 and 26*a*. The wires are positioned between the holes 40 in the second ground plane plate 36.

A focus plate 44 extends across each of the channels 26 and 26*a* adjacent to but spaced from the second ground plane plate 36, and an acceleration plate 46 extends across each of the channels 26 and 26*a* adjacent to but spaced from the focus plate 44. The focus plate 44 and the acceleration plate 46 are of an electrically conductive metal and extend the full length of the channel 26 and 26*a*. The focus plate 44 and the acceleration plate 46 each has three rows of holes 48 and 50 respectively therethrough with the holes 48 and 50 being in alignment with the holes 40 in the second ground plate 46.

In each of the channels 26 and 26*a* are a pair of spaced, substantially parallel deflection electrodes 52. The deflection electrodes 52 extend between the acceleration plate 46 and the shadow mask 32 along the entire length of the channel. Preferably, the deflection electrodes 52 are on the surfaces of the supporting walls 24 or side wall 22 which forms the sides of the particular channel 26 or 26*a*. On the inner surface of the front wall 18 in each keying channel 26*a* is a separate detector electrode 53 of an electrically conductive material, such as a metal. The detector electrodes 53 extend the full length of their respective keying channels 26*a*.

Figure 3:
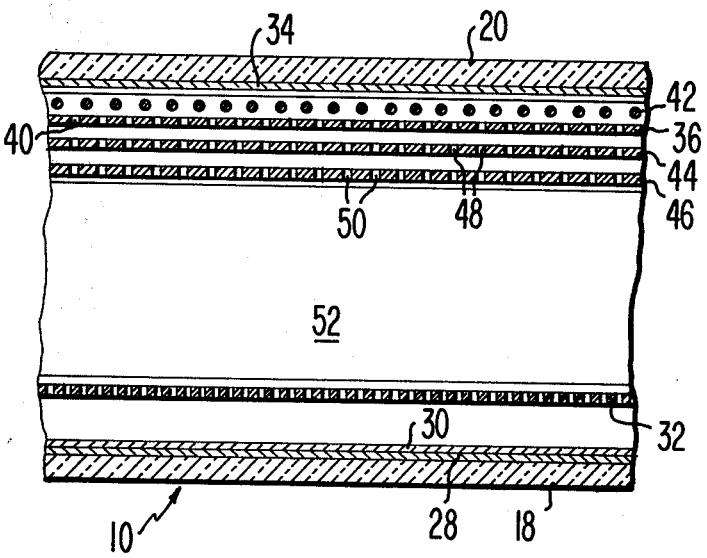
FIG. 3 is a sectional view of a portion of the display device taken along line 3—3 of FIG. 2.

The gun section 16 (FIG. 1) of the envelope 12 is an extension of the display section 14 and extends along one set of adjacent ends of the channels 26 and 26*a*. The gun section 16 may be of any shape suitable to enclose the particular gun structure contained therein. The electron gun structure contained in the gun section 16 may be of any well known construction suitable for selectively directing at least one beam of electrons along each of the channels 26 and 26*a*. For example, the gun structure may comprise a plurality of individual guns, one being mounted at one end of each of the channels for directing separate beams of electrons along each of the channels. For a color display device of the type shown in FIGS. 2 and 3, three electron beams are required along each of the channels 26 with each beam being directed along a separate one of the troughs 38 in the first ground plane plate 34 of the beam guide. However, for a black and white display device only a single beam is required for each channel.

Another type of gun structure which can be used includes a line cathode extending along the gun section 16 across the ends of the channels 26 and 26*a* and adapted to selectively direct individual beams of electrons along the channels. A gun structure of this type is described in U.S. Pat. No. 2,858,464 to W. L. Roberts, issued Oct. 28, 1958, entitled "Cathode Ray Tube".

No matter what type of gun structure is used in the gun section 16, the gun structure should also include means for modulating the electron beams according to a video input signal. As shown in FIG. 1, a terminal 55 extends through a side wall 22 of the envelope 12. The terminal 55 includes a plurality of terminal wires by which the gun structure and other parts of the display within the envelope 12 can be electrically connected to suitable operating circuitry and power source outside of the envelope 12.

In the operation of the display device 10, the gun structure in the gun section 16 generates and directs at least one beam of electrons into each of the channels 26 and 26*a*. For a color display device preferably three beams of electrons are directed into each of the display channels 26 and on a single beam into each of the keying channels 26*a*. The electron beams are directed between the ground plane plates 34 and 36 of the beam guide with each beam being directed along a separate one of the troughs 38 in the first ground plane plate 34. In the beam guides, the ground plane plates 34 and 36 are at ground potential and the wires 42 are at a positive potential. As described in the previously referred to pending application of T. Credelle, this causes each of the electron beams to travel in an undulating path through the wires 42 and between the ground plane plates 34 and 36 along the entire length of the channels 26 and 26*a*. The U-shape of the troughs 38 causes electrostatic forces to be applied to each of the electron beams as the beam passes between the wires 42 and the first ground plane plates 34 to confine the electrons of each beam between the sides of the troughs so that each beam will flow along a separate one of the troughs. Thus, each of the electron beams flows along a first portion of its path along its respective channel 26 from the gun section 16 to the side wall 22 of the envelope 12 opposite the gun section.

When the electron beams reach a selected point along the guide, the electron beams are deflected out of the first portion of its path into a second portion of its path which extends toward the front wall 18 of the envelope 12. This can be achieved by switching the potential applied to the wire 42 adjacent the side wall 22 to a negative potential, or, if the first ground plane 34 is in the form of a plurality of parallel strips, by switching the potential applied to the strip adjacent the side wall 22 to a negative potential. The selected point of deflection out of the guide is progressively moved along the guide toward the electron gun end thereof to effect vertical scanning.

The deflected electron beams pass out of the beam guide through adjacent holes 40 in the second ground plane plates 36. The electron beams will then pass through the holes 48 in the focus plate 44 and the holes 50 in the acceleration plate 46. A potential positive with respect to the second ground plane plate 36 is applied to the focus plate 44 so as to focus the beams as they pass through the holes 48, and a potential also positive with respect to the second ground plate 36 and preferably the same potential as that on the metal film 30, is applied to the acceleration plate 46 so as to accelerate the flow of the beams as they pass through the holes 50. The electron beam will then flow through the openings in the shadow mask 32 toward the phosphor screen 28.

As the electron beams flow along their second portions of their paths from the acceleration plate 46 to the phosphor screen 28, the electron beams pass between the deflection electrodes 52. Initially, one of the deflection electrodes 52 in each of the channels 26 and 26*a* is at a potential positive with respect to the potential applied to the metal film 30 on the phosphor screen 28 and the other of the deflection electrodes is at a potential negative with respect to the potential applied to the metal film 30. This causes the second portion of the paths of the electron beams to be deflected toward the deflection electrode which is at the positive potential. The potentials applied to the deflection electrodes 52 are such that the electron beams are deflected sufficiently to cause the beams to initially impinge on the phosphor screen 28 adjacent to the support wall 24 on which is the positively charged deflection electrode 52. The potentials applied to the deflection electrodes 52 are varied in conventional manner by application of appropriate deflection signals thereto to effect a horizontal scanning of the beam across a portion of the screen equal to the width of a channel. By similarly deflecting the beams in each of the channels across its respective channel, a visual line will be created across the full width of the phosphor screen 28 to achieve a complete horizontal line scan of the phosphor screen. The horizontal scanning of the phosphor screen 28 is combined with the vertical scanning to produce an entire scanned raster. By modulating the beams at the gun structure, a display can be achieved on the phosphor screen 28 which can be varied through the front wall 18 of the display device.

As the three beams in each of the display channels 26 are deflected transversely across their respective channel, each of the beams will pass through appropriate openings 33 in the shadow mask 32 so that each beam will activate a different colored phosphor strip of the screen 28, one being for the red phosphor, one for the blue-emitting phosphor and one for the green-emitting phosphor, to provide a display color as is well known in the art of shadow mask color kinescopes.

At the same time that the electron beams are directed along each of the display channels 26, a single electron beam is directed along each of the keying channels 26*a*. The beam in each of the keying channels 26*a* corresponds to a separate and different color one of the three beams in the display channels 26. Thus, the electron beam in one of the keying channels 26*a* corresponds to the beam in each of the display channels 26 that excites the red phosphor, the beam in a second of keying channels 26*a* corresponds to the beam in each of the display channels 26 that excites the blue-emitting phosphor, and the beam in the third of the keying channels 26*a* corresponds to each of the beams in the display channels 26 that excite the green-emitting phosphor. The beam in each of the keying channels 26*a* is guided along its keying channel in the same manner as previously described for the beams in the display channels. Also, the beam in each of the keying channels 26*a* is deflected out of its respective guide and deflected transversely across the keying channel simultaneously with the beam in the display channels.

As each of the beams in a keying channel is deflected transversely across its channel it passes through the openings 33*a* in the shadow mask 32*a* and impinges the detector electrode 53. The beam is of a diameter with respect to the size and spacing of the openings 33*a* in the shadow masks 32*a* that the beams will pass through substantially only one opening 33*a* at a time. Each time the beam impinges on the detector electrode 53, an electrical current is generated in the detector electrode. As the beam moves transversely across the shadow mask it sequentially passes through a plurality of openings 33*a* in the shadow mask to generate in the detector electrode 53 a plurality of current pulses. The timing between these current pulses provides a substantially continuous indication of the position of the beam along the entire length of its path transversely across the beam channel. Since the beam in each of the keying channels 26*a* is deflected transversely across its channels simultaneously with the beams in the display channels 26, the current pulses also provide an indication of the position of the beams in the display channels 26.

The detector electrodes 53 are each electrically connected through suitable switching circuitry to the circuit for modulating the respective beams in the display channels so that the current pulses generated in the detector electrodes will control the timing of the operation of the modulation circuit. For example, the video information may be stored in a memory to be fed to the modulation means for each of the beams in each of the channels 26 at the appropriate time. The pulse from the detector electrodes 53 can be used to clock out the video information from the memory. Thus, during each horizontal line scan by the electron beam, the appropriate modulation of the electron beams will occur each time a current pulse is generated by the beams in the keying panels impinging on the detector electrodes. Therefore, the video display will not be affected by the beams overscanning their channels or by being horizontally scanned at nonuniform speeds since the video signal for modulating the beams will only be fed to the beams in the display channels when current pulses are generated in the detector electrodes. The current pulses are only generated during the time that the beams in the keying channels are impinging upon their detector electrodes, which is the same time that the beams in the display channels are impinging on the phosphor screen, which prevents modulation of the beams during any overscan. The timing between current pulses will vary with any variation in the rate of the scan so that the beams will be properly modulated even though the speed of the scan varies. Although display device 10 is shown as having three keying channels, one for each of the color-generating beams in the display channels, for a monochrome display only a single keying channel is required.

Figure 4:
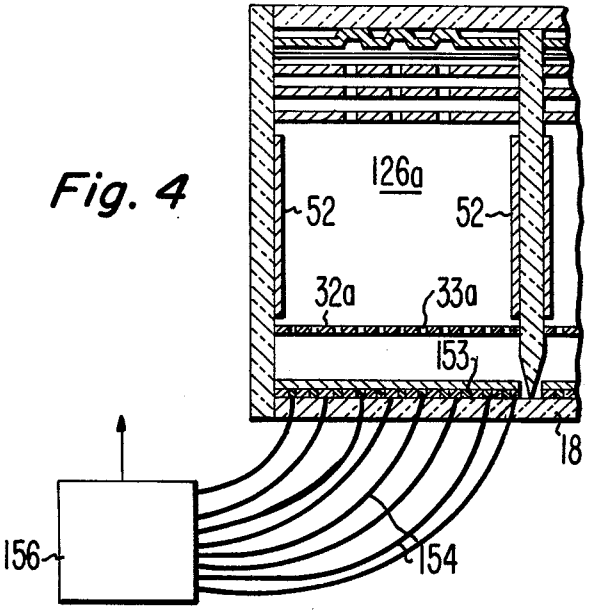
FIG. 4 is a sectional view similar to FIG. 2 showing a second form of the keying channel.

Referring to FIG. 4, another form of the keying channel which can be used in the display device of the present invention is generally designated 126*a*. The keying channel 126*a* is of the same structure as the keying channel 26*a* shown in FIG. 2 except that instead of a detector electrode 31 on the inner surface of the front wall 18, there is a phosphor screen 131 which is identical to the phosphor screen on the inner surface of the front wall in the display channels. As shown, the phosphor screen 153 is for a color display and includes a plurality of stripes of red, blue and green-emitting phosphors extending longitudinally along the keying channel 126*a*. A separate light guide 154, such as an optic fiber, extends from each of one color-emitting phosphor stripe, e.g., the red-emitting stripe, to a photodetector 156 which will convert a light signal to a current pulse. Although not shown, each of the blue-emitting phosphor stripes are similarly optically coupled to a separate photodetector and each of the green-emitting phosphor stripes are similarly optically coupled to a separate photodetector.

In the operating of the keying channel 126*a*, three electron beams are directed along the guide in the channel and are deflected out of the guide toward the front wall 18 along with the beams in the display channels. As the beams in the keying channel 126*a* pass from the guide to the front wall 18 they are deflected transversely across the channel by the deflector electrodes 52 simultaneously with the beams in the display channel. As each beam in the keying channel is deflected transversely across the channel it will pass through openings 33*a* in the shadow mask 32*a* and sequentially impinge on the phosphor stripes which emit a particular color, i.e., one beam will impinge upon the red-emitting phosphor stripes, a second beam will impinge on the green-emitting phosphor stripes and the third beam will impinge on the blue-emitting phosphor stripes. As a beam impinges on each of its respective phosphor stripes, the phosphor stripes will emit light which is transmitted by a light guide 154 to the detector 156 which in turn converts the light pulse to a current pulse. Thus, as each beam traverses the phosphor screen 153, its respective photodetector 156 will emit a series of current pulses, the spacing of which corresponds to the position of the beam across the keying channel. As previously described, with regard to the keying channels 26*a*, these current pulses can be used to control the modulation of the electron beams in the display channels.

Since the beams in the keying channel 126*a* must impinge on the phosphor stripes directly at the light guides 154, in order to minimize the number of light guides required the beams are deflected out of the beam guide at only one position, i.e., at the light guides, even though the beams in the display channels are deflected out of their guides at a plurality of positions along their channels. Although the display device has been described as having a single beam channel 126*a* with all three beams in the channel, the display device could have three separate keying channels 126*a* with a single beam in each channel similar to the display device having the three keying channels 26*a* shown in FIG. 2. For a monochrome display device, the keying channel 126*a* would have a monochrome phosphor screen 153 with only a single beam in the keying channel.

Figure 5:
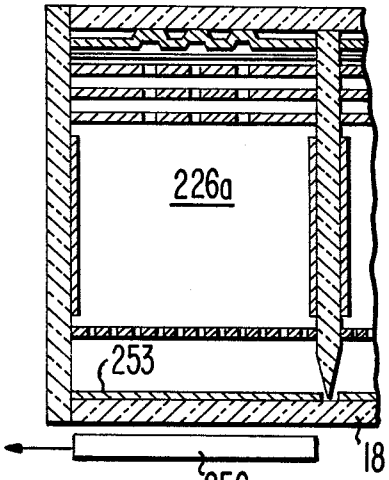
FIG. 5 is a sectional view similar to FIG. 2 showing a third form of the keying channel.

Referring to FIG. 5, another form of the keying channel which can be used in the display device of the present invention is generally designated 226*a*. The keying channel 226*a* is of the same structure as the keying channel 26*a* shown in FIG. 2 except that the detector electrode 53 on the inner surface of the front wall in each keying channel is replaced by a layer 253 of a material which emits ultraviolet (UV) radiation when impinged on by electrons. Across the keying channel portion of the front wall 18 is a radiation detector 256 which will convert UV radiation to an electrical current. In the operation of the display device, a beam of electrons is directed along the guide in the keying channel 226*a* and is deflected out of the beam guide toward the front wall 18. The beam in the keying channel 226*a* is then deflected transversely across the keying channel simultaneously with the transverse deflection of the beams in the display channel. The beam in the keying channel will pass through the openings in the shadow mask and impinge on the UV emitting layer 253. Each time the beam impinges on the UV emitting layer 253, a short burst of UV radiation is emitted which is picked up by the detector 256 and converted to a current pulse. Thus, as the beam in the keying channel is deflected transversely across the channel, it will cause the generation of a series of current pulses. As previously described, these current pulses can be used to control the modulation of the beams in the display channel. For a color display, the display would include the three keying channels 226*a*, one for each beam in each display channel, and for a monochrome display the display would include a single keying channel 226*a*. In the keying channel 226*a*, like in the keying channel 126*a* shown in FIG. 4, the beam is deflected toward the front wall 18 at only one position along the channel even though the beams in the display channels are deflected toward the phosphor screen at different points along their respective channels since the beam in the keying channel must impinge on the UV emitting layer at the radiation detector.

Figure 6:
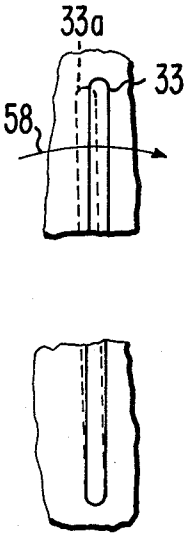
FIG. 6 is a schematic view showing the relative positions of the mask openings in a display channel and a keying channel.

Thus, in the display device of the present invention, the beams in the keying channels generate a series of current pulses which provide a substantially continuous indication of the position of the beams in the display channels as the beams scan across their respective portions of the phosphor screen. These pulses can then be used to control the modulation of the beams in the display channels to provide the desired visual display. However, a problem with using the current pulses to control the modulation of the beam arises from the fact that there is a delay from the gun section to the phosphor screen because of the electron transit time in the beam guide. Because of this delay, the video level lags the beam position by an amount proportional to the distance along the guide traveled by the electron beam. Thus, by the time a change in display information caused by a keying channel current pulse reached the phosphor screen, the beam in the display channel will have moved beyond the position where the display information is to be provided. This problem can be overcome by arranging the position of the openings in the keying channel shadow mask so that the beam in the keying channel passes through an opening in its shadow mask before the beams in the display channels pass through their corresponding openings in their shadow mask. Thus, the current pulses will be generated prior to the time that the beams in the display section reach their respective positions by a time equal to the delay time. For example, as shown in FIG. 6, if the beams are being deflected in the direction of arrow 58, the openings 33*a* in the keying channel display mask are disposed closer to the side of the channel from which the beam is coming than the openings 33 in the display channel. If the shadow mask openings 33 and 33*a* are elongated slots for a strip phosphor screen, the keying channel shadow mask openings 33*a* can be slanted with respect to the display channel shadow mask openings 33 so that the ends of the openings furthest from the gun section are further spaced apart than the ends closest to the gun section. This would automatically compensate for the variation in the delay time with the distance from the gun section. The spacing between the corresponding openings is equal to the transit time times the velocity of the transverse scan. The transit time can be determined as follows:

$$T = D_g\sqrt{\frac{m}{2QV}}$$

T=transit time
$D_g$=distance traveled in guide
m=electron mass
Q=electron charge
V=average electron energy in beam guide.

Although the present invention has been described with regard to a display device in which the beams of electrons are guided longitudinally along the channels before being deflected toward the phosphor screen at various points along the channel, it can be used in other forms of a display device wherein beams of electrons are directed through channels toward the phosphor screen and are deflected transversely across the channels by deflection electrodes to scan a portion of the screen. For example, the display may include a plurality of channels extending from the back wall of the envelope to the phosphor screen on the front wall, a plurality of cathodes on the back wall for generating beams of electrons and directing the electrons through the channels and deflection electrodes on the walls of the channels for deflecting the electron beams transversely across the channels. One such display device is shown in U.S. Pat. No. 3,935,500 to F. G. Oess et al, issued Jan. 27, 1976 entitled "Flat CRT System".

We claim:

1. An electron display device comprising
an evacuated envelope having a viewing window,
a phosphor screen along the inner surface of said window,
means in said device for generating a plurality of beams of electrons and directing said beams along paths at least portions of which extend toward said window so that at least some of said beams will impinge on said phosphor screen,
means along the portions of the paths which extend toward said window for simultaneously deflecting said beams so that the beams which impinge on said phosphor screen will each scan a portion of the phosphor screen,
means for substantially continuously detecting the position of at least one of said beams as the beam is deflected, wherein said detecting means comprising means, including a detector electrode upon which the beam impinges as the beam is deflected, for generating a series of current pulses as the beam is deflected with the time between the pulses providing an indication of the position of the beam, and
means whereby the beam intermittently impinges on the detector electrode, said means whereby the beam intermittently impinges on the detector electrode including a mask extending across the detector electrode, said mask having a plurality of spaced openings therethrough through which the beam passes as the beam is deflected.

2. An electron display device comprising
an evacuated envelope having a viewing window,
a phosphor screen along the inner surface of said window,
means in said device for generating a plurality of beams of electrons and directing said beams along paths at least portions of which extend toward said window so that at least some of said beams will impinge on said phosphor screen,
means along the portions of the paths which extend toward said window for simultaneously deflecting said beams so that the beams which impinge on said phosphor screen will each scan a portion of the phosphor screen,
means for substantially continuously detecting the position of at least one of said beams as the beam is deflected, wherein said detecting means includes means for generating a series of current pulses as the beam is deflected with the time between the pulses providing an indication of the position of the beam, said detecting means further includes,
a material which emits a spectral radiation when impinged on by the beam and means for converting the emitted radiation to an electrical current, and a mask extending across the material which emits spectral radiation, said mask having a plurality of spaced openings therethrough through which the beam passes as the beam is deflected.

3. An electron display device comprising:
an evacuated envelope having closely spaced, substantially parallel, front and back walls, and a plurality of spaced, substantially parallel support walls extending substantially perpendicularly between said front and back walls and forming a plurality of channels extending across said front and back walls, at least one of said channels being a keying channel and the remaining channels being display channels,
a phosphor screen along the inner surface of said front wall in each of said display channels,
means at one end of said channels for generating and directing at least one beam of electrons along each of said channels along a first path generally parallel to and along said front wall,
means in each of said display channels for selectively deflecting the beam in the display channels out of its first path at selected points along the display channel into second paths extending toward said phosphor screen so that the beams will impinge on the phosphor screen,
means in each keying channel for deflecting the beam in the keying channel out of its first path at at least one point along the keying channel into a second path extending toward the front wall,
means in each of said channels for deflecting the beam in the channel as it moves along its second paths in a plane which traverses the first path of the beam so that the beams in the display channels will scan the portion of the phosphor screen in the display channel transversely across the channel, and
means in each keying channel for substantially continuously detecting the position of the beam in the keying channel as the beam is deflected transversely across the keying channel.

4. The display device in accordance with claim 3 in which the means for detecting the position of the beam in the keying channel includes means for generating a series of current pulses as the beam is deflected transversely across the keying channel.

5. The display device in accordance with claim 4 in which the means for detecting the position of the beam in the keying channel includes a detector electrode extending transversely across the front wall in the keying channel, said electrode being impinged on by the beam in the keying channel as the beam is deflected transversely across the keying channel.

6. The display device in accordance with claim 5 including means whereby the beam in the keying channel intermittently impinges on the detector electrode.

7. The display device in accordance with claim 6 including a mask extending transversely across the keying channel between the detector electrode and the back wall, said mask having a plurality of spaced openings therethrough through which the beam passes as it is deflected transversely across the keying channel so that the beam will intermittently impinge on the detector electrode.

8. The display device in accordance with claim 7 including means for directing three beams along each of the display channels, and three of said keying channels with means for directing a single beam along each of the keying channels.

9. The display device in accordance with claim 4 in which the means for detecting the position of the beam in the keying channel includes a material which emits a spectral radiation when impinged on by the beam, said material being positioned transversely across the front wall, and means for connecting the emitted radiation to an electrical current.

10. The display device in accordance with claim 9 in which the material which emits spectral radiation includes a plurality of areas of the material spaced transversely across the front wall so as to be sequentially impinged upon by the beam in the keying channel as the beam is deflected transversely across the keying channel.

11. The display device in accordance with claim 9 including a mask extending transversely across the keying channel between the material which emits radiation and the back wall, said mask having a plurality of spaced openings therethrough through which the beam in the keying channel passes as it is deflected transversely across the keying channel.

* * * * *